US006862903B2

(12) United States Patent
Nitschmann et al.

(10) Patent No.: US 6,862,903 B2
(45) Date of Patent: Mar. 8, 2005

(54) SEALING DEVICE

(75) Inventors: Kai Nitschmann, Berlin (DE); Wolfgang Proppe, Berlin (DE)

(73) Assignee: BSH Bosch und Siemens Hausgerate GmbH, Munich (DE)

( * ) Notice: Subject to any disclaimer, the term of this patent is extended or adjusted under 35 U.S.C. 154(b) by 0 days.

(21) Appl. No.: 10/328,773

(22) Filed: Dec. 23, 2002

(65) Prior Publication Data

US 2003/0115915 A1 Jun. 26, 2003

Related U.S. Application Data

(63) Continuation of application No. PCT/EP01/07165, filed on Jun. 25, 2001.

(30) Foreign Application Priority Data

Jun. 27, 2000 (DE) ..... 100 31 172

(51) Int. Cl.[7] ..... D06F 23/00; F26B 25/00

(52) U.S. Cl. ..... 68/5 E; 68/20; 34/242; 34/601

(58) Field of Search ..... 68/12.26, 20, 139, 68/196, 5 E, 24, 58; 34/242, 601, 603

(56) References Cited

U.S. PATENT DOCUMENTS

| | | | | |
|---|---|---|---|---|
| 6,256,823 | B1 * | 7/2001 | Kronbetter et al. | 8/158 |
| 6,560,998 | B2 * | 5/2003 | Wright | 68/139 |
| 2004/0159009 | A1 * | 8/2004 | Hwang | 34/601 |
| 2004/0159010 | A1 * | 8/2004 | Hwang | 34/601 |

FOREIGN PATENT DOCUMENTS

| | | | |
|---|---|---|---|
| DE | 6 751 908 | U | 2/1969 |
| DE | 2403705 | A * | 8/1974 |
| DE | 374411 | A1 * | 6/1990 |
| EP | 0 533 635 | A1 | 3/1993 |
| EP | 0 657 574 | A1 | 6/1995 |
| GB | 2 114 606 | A | 8/1983 |

OTHER PUBLICATIONS

English abstract of previously filed German Published Non–Prosecuted Patent Application DE 38 43 385 A1 (Krimphoff et al.), dated Jul. 5, 1990.

English abstract of previously filed German Published Non–Prosecuted Patent Application DE 41 26 966 A1 (Bierbach et al.), dated Feb. 18, 1993.

* cited by examiner

*Primary Examiner*—Frankie L. Stinson
*Assistant Examiner*—Joseph L Perrin
(74) *Attorney, Agent, or Firm*—Laurence A. Greenberg; Werner H. Stemer; Gregory L. Mayback

(57) ABSTRACT

A sealing device is provided between a bullseye-shaped porthole of a loading door and a housing wall in washing machines or laundry dryers and includes a one-piece, substantially annular sealing collar. The porthole has an edge section, which extends substantially parallel to the plane of the loading door. The sealing device includes, at its end facing the porthole, a head section that is supported by a projection on an edge section of the housing wall limiting the door aperture. Furthermore, the sealing device includes a narrow, substantially annular sealing disk that, with the loading door closed, presses sealingly in the axial direction against the edge section of the porthole.

27 Claims, 2 Drawing Sheets

SEALING DEVICE

CROSS-REFERENCE TO RELATED APPLICATION

This application is a continuation of copending International Application No. PCT/EP01/07165, filed Jun. 25, 2001, which designated the United States and was not published in English.

BACKGROUND OF THE INVENTION

Field of the Invention

The present invention relates to a sealing device for providing a seal between a bullseye-shaped porthole in a loading door and a housing wall in household appliances, especially washing machines or laundry dryers.

In front-loading washing machines or laundry dryers, the loading door frequently is of a bullseye-shaped porthole that extends toward the interior of the washing machine to allow no dead space to be present between the laundry drum and the outside of the appliance, in which the laundry to be processed might be left. The bullseye-shaped porthole is connected to the doorframe in a conventional manner in its edge region by a hinge and lock. A suitable sealing device has to be inserted between the corresponding section of the housing wall and the loading door to provide a seal. Customarily, substantially annular sealing collars are used for such a purpose, the porthole pressing against the head end thereof when the loading door is closed and so sealingly closing off the interior space.

German Utility Model G 67 51 908 discloses a sealing device for providing a seal between a bullseye-shaped porthole of a loading door and a housing wall in washing machines, which includes a substantially annular sealing collar. When the loading door is closed, the porthole presses substantially radially, by a conical section, against the shallowly lip-shaped head section of the sealing collar.

A disadvantage of the prior art sealing device is that it reacts sensitively to tolerances in two degrees of freedom. First, during closing, a loading door undergoes a rotary movement, which is expressed as an inward-directed axial movement at the point of impact on the sealing device. For the latching element to engage into the lock, however, the loading door is lifted slightly in the hinge shortly before closing, in other words, the loading door undergoes, as a result of centering in the cut-out in the housing, a translational movement in the direction of the plane of the loading door. These movements generated during, respectively, the closing and opening operations may disadvantageously influence the sealing function of the sealing device present. An additional factor is that the relatively broad head end of the sealing collar may become stuck to the porthole under heavy contact pressure, so that after the latch is released, the loading door may, nevertheless, remain closed. In particular, this may disadvantageously become apparent in the event of a malfunction during the washing operation, for example, if, as a result of defective pumping out of liquid or liquor, a safety lock prevents the opening of the lock of the loading door. In such a case, admittedly, the lock can be disengaged mechanically by activation of a Bowden cable. If, however, the loading door remains stuck to the sealing device, the customer becomes irritated, with the user assuming that the closure is defective, failing to allow the opening of the door. Frequently, the customer, then, makes unnecessary calls upon customer service.

SUMMARY OF THE INVENTION

It is accordingly an object of the invention to provide a sealing device that overcomes the hereinafore-mentioned disadvantages of the heretofore-known devices of this general type and that exhibits low sensitivity to tolerances, ensures reliability of sealing even in the event of axial or translational movement of the porthole, as, for example, during closing of the loading door, and does not remain stuck to the porthole even under heavy contact pressure so that the opening of the loading door is not prevented.

With the foregoing and other objects in view, there is provided, in accordance with the invention, a household appliance including a housing having a wall defining a door aperture, the door aperture having an edge section with a projection, a loading door defining a door plane, a bullseye-shaped porthole disposed in the door, the porthole having an edge section extending one of substantially in the door plane and substantially parallel to the door plane and a porthole axis, and a sealing device providing a seal between the porthole and the wall, the sealing device having a one-piece, substantially annular sealing collar with an end facing the porthole, a head section at the end supported by the projection, and at least one substantially annular sealing disk sealingly pressing in an axial direction with respect to the porthole axis against the edge section of the porthole when the loading door is closed. Preferably, the household appliance is a washing machine and/or a laundry dryer.

According to the invention, the sealing device includes, at its end facing the porthole, a head section that is supported by a projection on an edge section of the housing wall limiting the door aperture, and at least one substantially annular first sealing disk that, with the loading door closed, presses sealingly in the axial direction against the edge section of the porthole. Thus, advantageously, a sealing device is provided that includes only a sealing plane lying in the direction of the translational degree of freedom of the loading door and, therefore, reacts less sensitively to existing tolerances.

A radially acting sealing lip would have to be wider than an axially acting one and is, therefore, subject to the risk that it is forced open by the force of surging water. In addition, with a radially acting sealing lip, the closing and opening forces increase, which is disadvantageous in terms of user-friendliness. Finally, such a seal also lacks the lifter function for the loading door that is, advantageously, present in the case of axially acting seals, and, as a result of which, the loading door is moved up automatically in the opening direction during unlocking of the loading door.

In accordance with another feature of the invention, the sealing disk extends obliquely with respect to the edge section of the porthole.

In accordance with a further feature of the invention, advantageously, the head section includes a second, narrow, substantially annular sealing disk, which encloses an acute angle with the first sealing disk, which results in more reliable sealing when the sealing disk, with the loading door closed, presses sealingly against the edge section of the porthole.

In accordance with an added feature of the invention, it is particularly advantageous if the second sealing disk presses sealingly against the inside of the loading door in the axial direction with the loading door closed. As a result, the risk of a water escape is eliminated even in the event of major axial lateral movements of the porthole. In addition, the joint between the frame and the porthole is further sealed thereby.

In accordance with an additional feature of the invention, the loading door has a doorframe with an inside and the second sealing disk sealingly presses against the inside of the doorframe in the axial direction when the loading door is closed.

With the objects of the invention in view, in a household appliance having a housing wall defining a door aperture with an edge section having a projection, a loading door defining a door plane; and a bullseye-shaped porthole disposed in the door, the porthole having a porthole axis and an edge section extending one of substantially in the door plane and substantially parallel to the door plane, there is also provided a sealing device for providing a seal between the porthole and the wall, the sealing device including a one-piece, substantially annular sealing collar having an end facing the porthole, a head section at the end to be supported by the projection, and at least one substantially annular sealing disk sealingly pressing in an axial direction with respect to the porthole axis against the edge section of the porthole when the loading door is closed.

With the objects of the invention in view, there is also provided a sealing device for a household appliance, the sealing device including a one-piece, substantially annular sealing collar having an end to be disposed facing a bullseye-shaped porthole in a loading door of the appliance, the loading door defining a door plane, the porthole having a porthole axis and an edge section extending one of substantially in the door plane and substantially parallel to the door plane, a head section at the end to be supported by a projection on an edge section of a door aperture defined by the housing wall, at least one substantially annular sealing disk adapted to sealingly press in an axial direction with respect to the porthole axis against the edge section of the porthole when the loading door is closed and establish a seal between the porthole and the housing wall.

Other features that are considered as characteristic for the invention are set forth in the appended claims.

Although the invention is illustrated and described herein as embodied in a sealing device, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
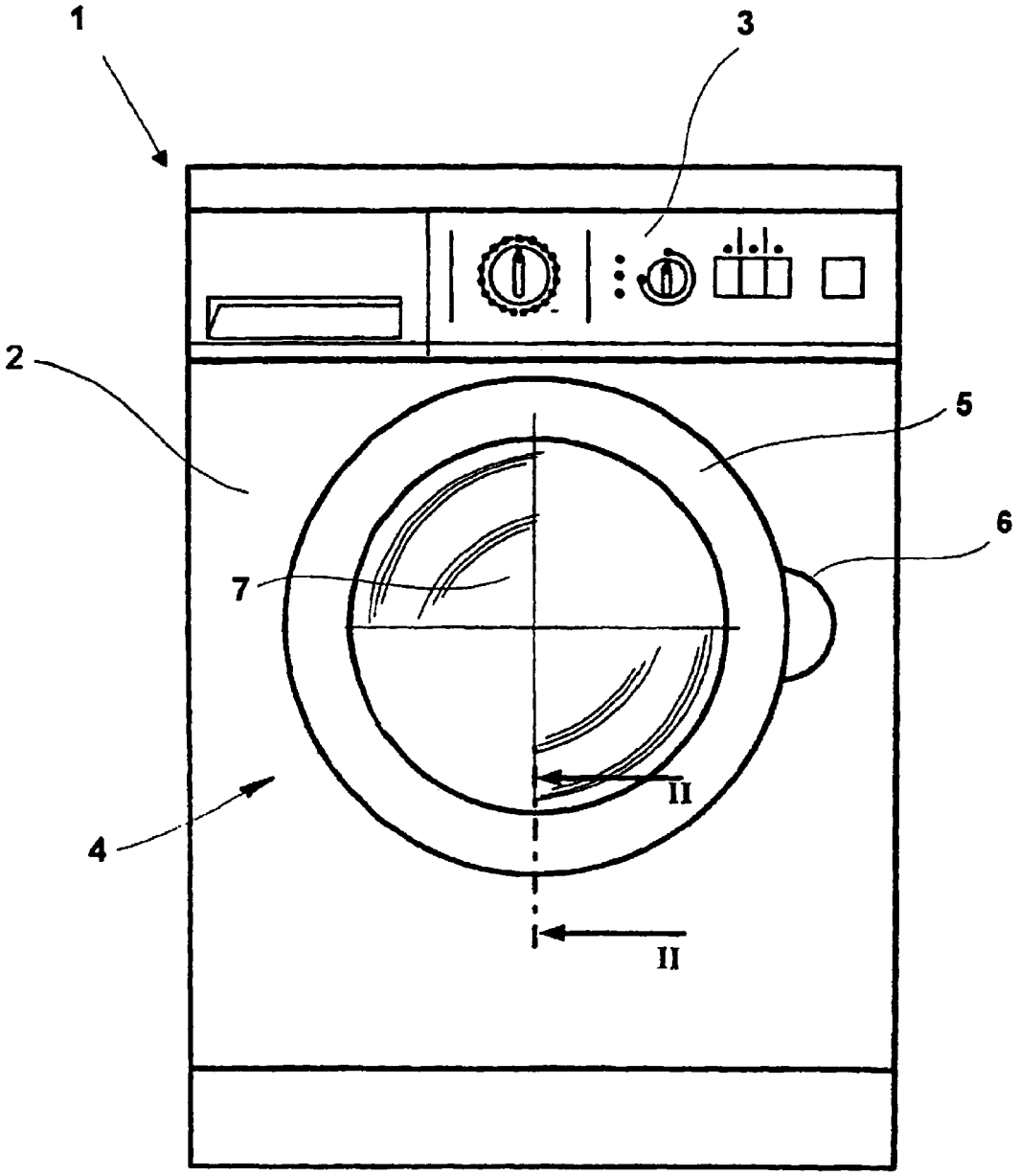
FIG. 1 is a front, plan view of a front-loading washing machine having a bullseye-type loading door according to the invention.

Referring now to the figures of the drawings in detail and first, particularly to FIG. 1 thereof, there is shown only the front of a washing machine 1 with the housing wall 2 and the operating console 3 is visible. The housing wall 2 contains a loading door 4 with a frame 5, in which a porthole 7 is fixed and that can be held in the closed position by a closure 6.

Figure 2:
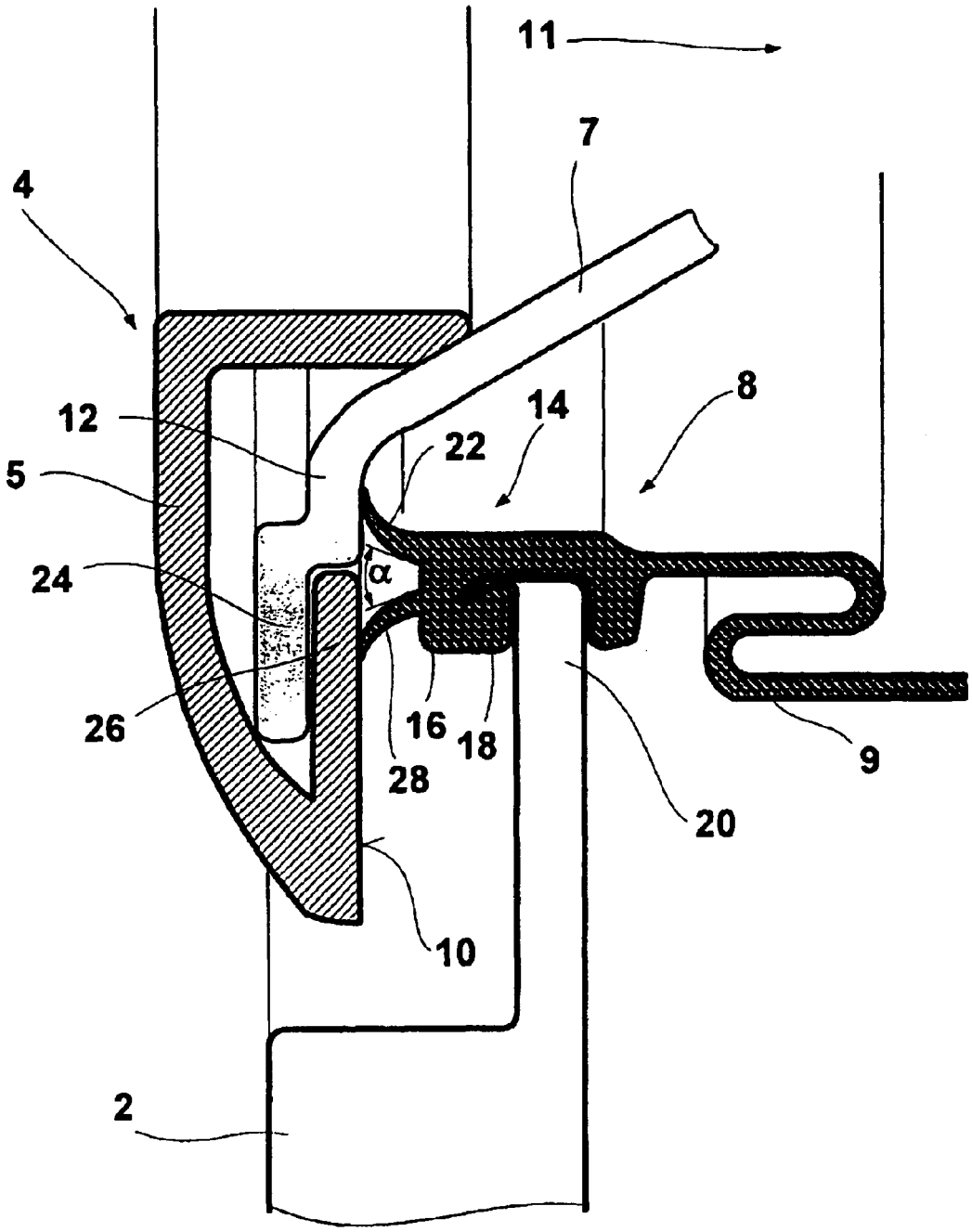
FIG. 2 is a fragmentary, cross-sectional view along section II—II in FIG. 1 of an embodiment of the sealing device according to the invention with the loading door closed.

FIG. 2 shows a preferred embodiment of the sealing device 8 according to the invention. The loading door 4 is formed by a cup-shaped porthole 7 and a doorframe 5. The porthole 7 includes at its outer end an edge section 12, which is limited by a continuation 24, which extends first substantially at right angles to the plane of the loading door and, subsequently, parallel thereto. A corresponding projection 26 is configured on the inside 10 of the doorframe 5 and serves as a bearing for the continuation 24 of the edge section 12 of the porthole 7. The aperture 11 of the loading door 4 is limited by an edge section 20 of the housing wall 2. The sealing collar 9 includes, on its end 14 facing the porthole 7, a head section 16 that is supported by a projection 18 on the edge section 20 of the housing wall 2. The end of the head section 16 facing the loading door 4 forms two narrow, substantially annular sealing disks 22 and 28, lying at an angle $\alpha$ to one another. The first sealing disk 22 presses obliquely against the axis of the loading door and the edge section 12 of the porthole 7. The second sealing disk 28 presses against the projection 26 on the inside 10 of the door frame 5 that serves to support the porthole 7.

When the loading door 4 is closed, the edge section 12 of the porthole 7 presses axially against the first sealing disk 22. As a result, reliable sealing is guaranteed. Because of the narrow width of the sealing disk 22, the translational movements of the loading door 4 toward the plane of the loading door that additionally occur during the latching operation of the closure 6 have no disadvantageous effects. In the preferred embodiment described here, the second sealing disk 28 simultaneously presses against the projection 26 formed on the inside 10 of the door frame 5. This ensures that, even in the event of relatively strong axial outward movements of the porthole, the sealing function of the device 8 is retained, even when the first sealing disk 22 no longer rests on the edge section 12 of the porthole 7. Because of the narrow width of the sealing disks 22, 28, moreover, sticking of the sealing device 8 to the porthole 7 under heavy contact pressure is prevented so that the loading door 4 can easily be reopened in all cases.

It is also possible to use narrow sealing disks whose profile has a different geometrical shape. The second sealing disk 28 is not absolutely necessary to the invention, but the second sealing disk 28 does improve the sealing properties of the sealing device 8. With the loading door 4 closed, the second sealing disk 28 can also press against the edge section 12 of the porthole 7 or against the joint formed between edge section 12 and projection 26. With a configuration of the joint between the porthole 7 and the doorframe 5 of suitably sealing form, a single sealing disk 22 can also suffice, this resting against the inner surface of the doorframe 5.

We claim:

1. A household appliance, comprising:

a housing having a wall defining a door aperture, said door aperture having an edge section with a projection;

a loading door defining a door plane;

a bullseye-shaped porthole disposed in said door, said porthole having:

an edge section extending substantially parallel to said door plane; and a porthole axis; and a sealing device providing a seal between said porthole and said wall, said sealing device having a one-piece, substantially annular sealing collar with:

an end facing said porthole;

a head section at said end supported by said projection; and at least one substantially annular sealing disk sealingly pressing in an axial direction with respect to said porthole axis against said edge section of said porthole when said loading door is closed.

2. The sealing device according to claim 1, wherein said sealing disk extends obliquely with respect to said edge section of said porthole.

3. The sealing device according to claim 1, wherein said head section has a second, substantially annular sealing disk enclosing an angle with said sealing disk in an unloaded position of said loading door.

4. The sealing device according to claim 2, wherein said head section has a second, substantially annular sealing disk enclosing an angle with said sealing disk in an unloaded position of said loading door.

5. The sealing device according to claim 3, wherein said second sealing disk sealingly presses against said edge section of said porthole in said axial direction when said loading door closed.

6. The sealing device according to claim 4, wherein said second sealing disk sealingly presses against said edge section of said porthole in said axial direction when said loading door closed.

7. The sealing device according to claim 3, wherein:

said loading door has a door frame with an inside; and said second sealing disk sealingly presses against said inside of said doorframe in said axial direction when said loading door is closed.

8. The sealing device according to claim 4, wherein:

said loading door has a door frame with an inside; and said second sealing disk sealingly presses against said inside of said doorframe in said axial direction when said loading door is closed.

9. The sealing device according to claim 1, wherein the household appliance is one of a washing machine and a laundry dryer.

10. In a household appliance having:

a housing wall defining a door aperture with an edge section having a projection;

a loading door defining a door plane; and a bullseye-shaped porthole disposed in the door, the porthole having a porthole axis and an edge section extending substantially parallel to the door plane, a sealing device for providing a seal between the porthole and the wall, the sealing device comprising:

a one-piece, substantially annular sealing collar having:

an end facing the porthole;

a head section at said end to be supported by the projection;

at least one substantially annular sealing disk sealingly pressing in an axial direction with respect to the porthole axis against the edge section of the porthole when the loading door is closed.

11. The sealing device according to claim 10, wherein said sealing disk extends obliquely with respect to the edge section of the porthole.

12. The sealing device according to claim 11, wherein said head section has a second, substantially annular sealing disk enclosing an angle with said sealing disk in an unloaded position of the loading door.

13. The sealing device according to claim 10, wherein said head section has a second, substantially annular sealing disk enclosing an angle with said sealing disk in an unloaded position of the loading door.

14. The sealing device according to claim 12, wherein said second sealing disk sealingly presses against the edge section of the porthole in the axial direction when the loading door closed.

15. The sealing device according to claim 13, wherein said second sealing disk sealingly presses against the edge section of the porthole in the axial direction when the loading door closed.

16. The sealing device according to claim 12, wherein:

the loading door has a door frame with an inside; and said second sealing disk sealingly presses against the inside of the doorframe in the axial direction when the loading door is closed.

17. The sealing device according to claim 13, wherein:

the loading door has a door frame with an inside; and said second sealing disk sealingly presses against the inside of the doorframe in the axial direction when the loading door is closed.

18. The sealing device according to claim 10, wherein the household appliance is one of a washing machine and a laundry dryer.

19. A sealing device for a household appliance, the sealing device comprising:

a one-piece, substantially annular sealing collar having:

an end to be disposed facing a bullseye-shaped porthole in a loading door of the appliance, the loading door defining a door plane, the porthole having a porthole axis and an edge section extending substantially parallel to the door plane;

a head section at said end to be supported by a projection on an edge section of a door aperture defined by the housing wall;

at least one substantially annular sealing disk adapted to sealingly press in an axial direction with respect to the porthole axis against the edge section of the porthole when the loading door is closed and establish a seal between the porthole and the housing wall.

20. The sealing device according to claim 19, wherein said sealing disk extends obliquely with respect to the edge section of the porthole.

21. The sealing device according to claim 20, wherein said head section has a second, substantially annular sealing disk enclosing an angle with said sealing disk in an unloaded position of the loading door.

22. The sealing device according to claim 19, wherein said head section has a second, substantially annular sealing disk enclosing an angle with said sealing disk in an unloaded position of the loading door.

23. The sealing device according to claim 21, wherein said second sealing disk sealingly presses against the edge section of the porthole in the axial direction when the loading door closed.

24. The sealing device according to claim 22, wherein said second sealing disk sealingly presses against the edge section of the porthole in the axial direction when the loading door closed.

25. The sealing device according to claim 21, wherein:

the loading door has a door frame with an inside; and said second sealing disk sealingly presses against the inside of the doorframe in the axial direction when the loading door is closed.

26. The sealing device according to claim 22, wherein:

the loading door has a door frame with an inside; and said second sealing disk sealingly presses against the inside of the doorframe in the axial direction when the loading door is closed.

27. The sealing device according to claim 19, wherein the household appliance is one of a washing machine and a laundry dryer.

* * * * *